United States Patent [19]

Ponte

[11] 4,444,137

[45] Apr. 24, 1984

[54] SEWING MACHINE NEEDLE CLAMP

[75] Inventor: Gary W. Ponte, Passaic, N.J.

[73] Assignee: The Singer Company, Stamford, Conn.

[21] Appl. No.: 481,546

[22] Filed: Apr. 4, 1983

[51] Int. Cl.[3] ..... D05B 55/04

[52] U.S. Cl. ..... 112/226

[58] Field of Search ..... 112/226

[56] References Cited

U.S. PATENT DOCUMENTS 2,973,733 3/1961 Johnson .

3,344,761 10/1967 Ross ..... 112/226

4,242,975 1/1981 Knowles et al. .

4,329,934 5/1982 Hanyu et al. ..... 112/226

*Primary Examiner*—Werner H. Schroeder

*Assistant Examiner*—Andrew M. Falik

*Attorney, Agent, or Firm*—Robert E. Smith; Edward L. Bell

[57] ABSTRACT

A sewing machine needle clamp is disclosed which will accommodate a sewing machine needle with a flatted butt in only one predetermined orientation by virtue of overlapping recesses formed by mold inserts which define a composite needle accommodating channel with filleted corners permitting needle insertion in only one predetermined orientation.

4 Claims, 5 Drawing Figures

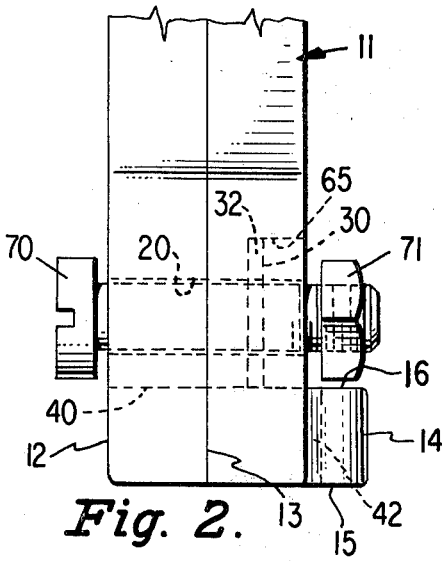
Fig. 2.
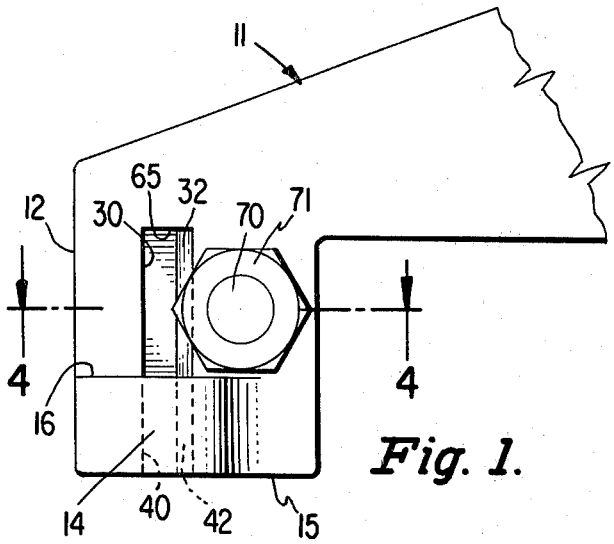
Fig. 1.
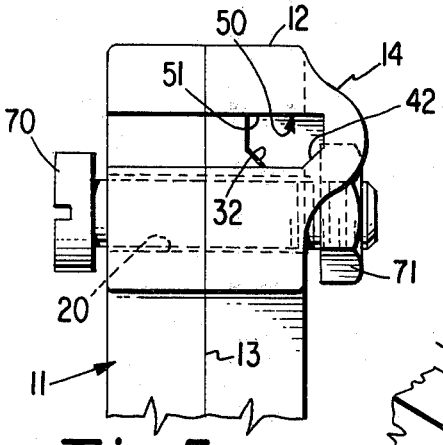
Fig. 3.
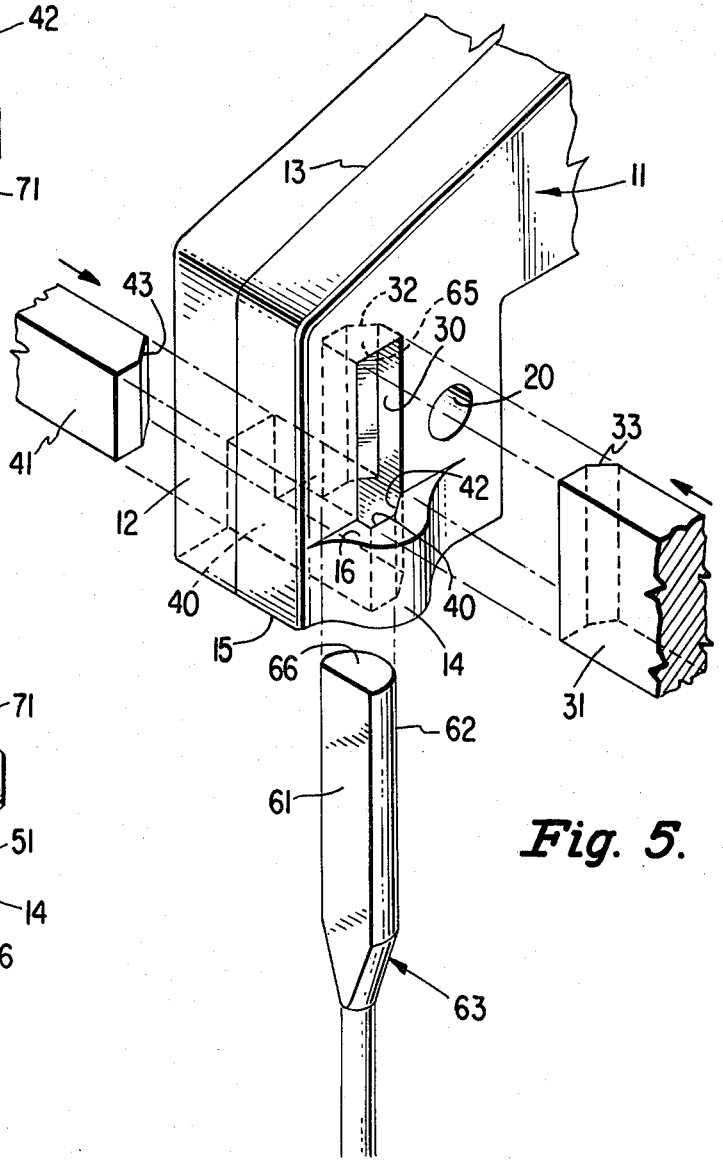
Fig. 5.
Fig. 4.
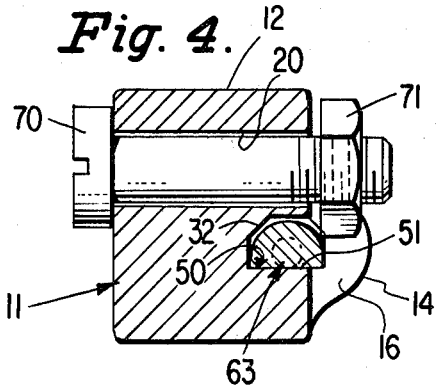

SEWING MACHINE NEEDLE CLAMP

DESCRIPTION

BACKGROUND OF THE INVENTION

This invention relates to a needle clamp for a household sewing machine, and more particularly, to a cost effective sewing machine needle clamp construction which will permit insertion of a household sewing machine needle in only the proper orientation therein.

Sewing machine needles which are intended for household sewing machine use conventionally include a butt extremity formed with a flat having a predetermined orientation with respect to the needle eye. The flat is not only formed perpendicular to the needle eye, but is arranged in a plane which is spaced a predetermined distance from the blade in which the needle eye is formed. Related to this needle formation is the conventional household sewing machine construction which provides the needle carrier with a corresponding flat surface against which the flat of the needle butt, if maintained, will automatically position the needle for proper cooperation with associated stitch forming mechanisms in the sewing machine. Various expedients are also known in the sewing machine art for so constricting the shape of the needle butt accommodating recess in a needle clamp that the needle can be admitted in only one way, i.e., the proper orientation. Such prior one way needle insertion clamps, however, have been catagorized by appreciable expense incident to either the requirement for separate inserts, gibs or the like, or the requirement for expensive machining operations such as broaching or the like.

SUMMARY OF THE INVENTION

It is an object of this invention to provide a one way needle insertion clamp of highly cost effective construction which may be incorporated on an endwise reciprocatory needle bar or on an oscillating or rocking needle carrying lever or the like, and which may be formed by a single molding or pressing operating without requirement for any subsequent machining steps.

DESCRIPTION OF THE DRAWINGS

With the above and additional objects and advantages in view, as will hereinafter appear, this invention will now be described with reference to a preferred embodiment illustrated in the accompanying drawings in which:

FIG. 1 is a side elevational view of the needle clamp portion of a sewing machine needle bar embodying this invention but shown without a needle therein, FIG. 2 is an end elevational view of the sewing machine needle bar of FIG. 1, FIG. 3 is a bottom plan view of the sewing machine bar of FIG. 1, FIG. 4 is a cross-sectional view taken substantially along line 4—4 of FIG. 1 and illustrating the butt portion of a sewing machine needle secured in the needle clamp of this invention, and FIG. 5 is a perspective view of the needle clamp portion of the needle bar with the clamp screw and clamp nut omitted, but showing a needle butt in position for insertion and showing the die inserts required to form the needle butt accommodating recess with the die inserts illustrated in retracted positions.

DESCRIPTION OF THE INVENTION

Referring to the drawings, 11 indicates a needle carrying lever of a sewing machine, although this invention may be used as well with any known endwise reciprocable needle bar or other sewing machine needle carrier. Preferably formed integral with the needle carrying lever 11 and depending therefrom is a needle clamp portion 12.

Indicated at 13 in FIGS. 1 and 5 is the parting line, preferably defining a single plane, perpendicularly toward and away from which mold halves or forming dies are adapted to move in the fabrication of the needle clamp of this invention. The following description of the needle clamp configuration will be based upon a molding technique, as for instance, injection molding.

The shape of the needle clamp portion 12 is substantially rectangular except for a projection 14 formed at one side and extending from the bottom free extremity 15 of the needle clamp portion to a shelf 16.

Indicated at 20 is a clearance hole formed through the needle clamp portion 12 perpendicular to the parting line 13 which may be formed by appropriate mold inserts (not shown) or by a simple drilling operation.

Alongside the clearance hole 20, the needle clamp portion 12 is formed with two contiguous interdigitated recesses 30 and 40 preferably formed by two mold inserts 31 and 41, respectively, which extend in overlapping relation during the molding operation and are withdrawn in opposite directions from the respective recess mouths to release the molded needle clamp. Preferably, the recesses 30 and 40 meet and are contiguous at the level of the shelf 16 and the lowermost recess 40 extends partway into the projection 14.

Each of the recesses 30 and 40, moreover, is formed with one beveled or filleted inside corner 32, 42, respectively, and this may be provided by corresponding beveled portions 33, 34, respectively, on the mold inserts 31, 41.

As best illustrated in FIG. 3, the two recesses 30 and 40 are complementary to each other together forming a composite needle butt accommodating channel 50 which is open to the bottom 15 of the needle clamp portion. Preferably the beveled inside corners 32 and 42 are arranged on that side of the channel adjacent to the clearance hole 20 so that only on the other side of the channel 50 is a flat surface 51 provided which is wide enough to accommodate a flat 61 formed on the cylindrical butt 62 of a conventional household sewing machine 63.

Such a conventional household sewing machine needle is illustrated in FIG. 5 and the cross-sectional shape of the needle butt is shown in FIG. 4 in place in the channel 50.

The proportions of the composite channel 50 are such as to prohibit insertion of a needle if it is turned at right angles to the position shown in FIGS. 4 and 5 and the beveled portions 33, 43 of the composite channel 50 would interfere with and prohibit insertion of the needle if an attempt is made to turn the needle backwards, i.e., 180° from that shown in FIGS. 4 and 5.

The upper extremity 65 of the recess 30 provides an upper stop for contact by the butt end 66 of a needle in the clamp thus establishing predetermined relationship with other stitch forming mechanism (not shown) of any conventionally organized sewing machine to which the needle carrier of this invention may be applied.

Since the recess 40 extends partway into the projection 14, a needle butt 62 when inserted into the channel 50 will protrude proud of the mouth of the recess 30.

For securing a needle in the needle carrier, a needle clamp screw 70 is passed through the clearance hole 20 and a nut 71 is threadedly engaged on the needle clamp screw above the projection 14. As shown in FIGS. 1, 3 and 4, the nut overlies the beveled portion 42 of the recess 40 and extends adjacent to the recess 30 that when a needle is inserted into the composite channel 50 and the needle clamping screw is tightened, the nut 71 will bear against the cylindrical needle butt 62 along that portion which is proud of the mouth of recess 30 thus forcing the needle flat 61 tightly against the flat surface 51 of the channel 50 and securely fastening the needle in the lever 11. The location of the nut immediately above the shelf 16 provided by the projection 14 inhibits turning of the nut to facilitate clamping of the needle in place by turning of the clamp screw 70.

It is understood that the present disclosure relates to a preferred embodiment of the invention which is for purposes of illustration only, and that various modifications may be made therein without departing from the spirit and scope of the invention as defined in the appended claims.

I claim:

1. A sewing machine needle clamp for accommodating in only one predetermined orientation the cylindrical butt of a sewing machine needle formed with a lengthwise flat at one side, a needle carrying member having a free extremity, said needle carrying member being formed with a plurality of interdigitated recesses, each of said recesses projecting only part way into said needle carrying member from mouths arranged on opposite sides thereof, said recesses overlapping each other and formed with contiguous complementary surfaces, that one of said recesses which is closest to the free extremity of said needle carrying member communicating with said free extremity at least along that segment of its length which is opposite to the overlapping portions of said plurality of recesses, the same one side of each of said plurality of recesses being formed substantially flat over its entire length, the opposite side of each of said plurality of recesses being formed with a filleted corner, whereby a composite needle butt accommodating channel is provided in the needle carrying member extending from the free extremity and successively through each of said plurality of recesses, said composite needle butt accommodating channel conforming generally in cross sectional shape to that of a cylindrical sewing machine needle butt with a lengthwise flat at one side, and clamp means carried by said needle carrying member and engageable adjacent the mouth of one of said recesses with the cylindrical butt of a sewing machine needle inserted into said needle butt accommodating channel.

2. A sewing machine needle clamp as set forth in claim 1 in which said needle carrying member at one side is formed with a projection into which at least one of said plurality of recesses extends sufficiently far that a needle butt placed in the needle butt accommodating channel provided thereby will be exposed proud of the side of the needle carrying member adjacent to said projection and in which said clamp means is arranged for engagement with that portion of a needle butt which is exposed proud of the side of the needle carrying member adjacent to said projection.

3. A sewing machine needle clamp as set forth in claim 2 in which said clamp means comprises a threaded bolt constrained in said needle carrying member adjacent to said needle butt accommodating channel and in flanged member associated with said bolt and projecting across the needle butt portion which is exposed proud of the side of the needle carrying member.

4. A sewing machine needle clamp as set forth in claim 3 in which said flanged member comprises a polygonal faceted nut threadedly engaged on side bolt, one of the polygonal facets of said nut bearing against said projection to constrict turning of said nut relatively to said bolt.

* * * * *